US006505766B2

(12) United States Patent
Cheung et al.

(10) Patent No.: US 6,505,766 B2
(45) Date of Patent: Jan. 14, 2003

(54) FEED WHEEL FOR STRAPPING TOOL

(75) Inventors: Nelson Cheung, Hoffman Estates, IL (US); Richard L. Mallory, Buffalo Grove, IL (US)

(73) Assignee: Illinois Tool Works Inc., Glenview, IL (US)

( * ) Notice: Subject to any disclaimer, the term of this patent is extended or adjusted under 35 U.S.C. 154(b) by 69 days.

(21) Appl. No.: 09/821,911

(22) Filed: Mar. 30, 2001

(65) Prior Publication Data

US 2002/0139829 A1 Oct. 3, 2002

(51) Int. Cl.[7] ..... B65H 20/00; B65B 13/22
(52) U.S. Cl. ..... 226/193; 100/32; 254/216
(58) Field of Search ..... 226/193; 100/29, 100/32; 254/216, 221; 140/93.2

(56) References Cited

U.S. PATENT DOCUMENTS 3,265,355 A * 8/1966 Martin et al. ..... 254/216
3,284,049 A * 11/1966 Haraden ..... 254/216
3,309,061 A * 3/1967 Plattner ..... 140/93.2
3,396,889 A * 8/1968 Annis, Jr. ..... 100/26
3,612,480 A * 10/1971 Guy ..... 140/93.4
3,612,481 A * 10/1971 Guy ..... 140/93.4
4,817,519 A 4/1989 Brouse et al.
5,024,149 A 6/1991 Kato
5,133,532 A 7/1992 Figiel et al.
5,368,278 A 11/1994 Kurmis
5,632,851 A 5/1997 Young
6,345,648 B1 * 2/2002 Cheung ..... 140/93.2

* cited by examiner

*Primary Examiner*—Michael R. Mansen
(74) *Attorney, Agent, or Firm*—Schwartz & Weinrieb

(57) ABSTRACT

A traction feed wheel, for use in connection with the tensioning of strapping material, is provided with a first set of teeth upon an outer peripheral surface of the feed wheel in accordance with a 15° right hand helix as considered with respect to the axis of the feed wheel. In addition, a plurality of cuts, formed upon the outer peripheral surface of the feed wheel in accordance with a 20° left hand helix with respect to the axis of the feed wheel, intersect the first set of teeth so as to discretely separate the first set of teeth into adjacent tooth sections or segments, and in addition, to define a second set of teeth upon the outer peripheral surface of the feed wheel. This tooth structure serves to prevent the generation of slivers from the strapping material during a strap tensioning operation thereby rendering the strapped articles safe to end users and preserving the tensile strength properties and structural integrity of the strapping material.

27 Claims, 2 Drawing Sheets

FEED WHEEL FOR STRAPPING TOOL

FIELD OF THE INVENTION

The present invention relates generally to a feed wheel or traction wheel which is utilized in conjunction with binding apparatus for securely binding articles, such as, for example, strip coils, tubes, stacked plate, and the like, with suitable strapping material, and more particularly to a new and improved feed wheel or traction wheel which, in addition to having a conventional set of circumferentially spaced teeth formed thereon, is provided with an additional set of teeth which are oriented in a substantially opposite direction with respect to the axis of the feed wheel or traction wheel so as to effectively prevent the generation of slivers when the feed wheel or traction wheel is used, for example, to securely bind articles with strapping material.

BACKGROUND OF THE INVENTION

As disclosed, for example, within U.S. Pat. No. 5,024,149 which issued to Kato on Jun. 18, 1991, and as illustrated in FIG. 1 of the drawings which corresponds to FIG. 5 of the drawings of the aforenoted patent to Kato, when a strap-binding operation is to be performed in connection with the securing or binding of articles with strapping material, the operation is normally carried out or performed by means of a multi-functional binding head 1. Briefly, in accordance with such a strap-binding operation, a band-like binding strap 3 is initially fed, in a forward direction f by means of a pair of reversible-drive rollers 2, from a supply source 3*c* of strapping material such that the binding strap 3 encircles the article 4 to be bound.

Upon completion, in effect, of the formation of a closed loop around the article 4, the leading end portion 3*a* of the binding strap 3 is gripped by means of a suitable gripper apparatus or unit, not shown, disposed within the binding head 1, and subsequently, the rotational drive of the pair of drive rollers 2 is reversed such that the trailing end portion 3*b* of the binding strap 3 is retracted in the reverse direction tt such that the binding strap 3 is preliminarily tightened around the article 4. Subsequently, the reverse drive of the rollers 2 is continued whereby the binding strap 3 is tightened around the article 4 with a substantially high degree of tension, and while the binding strap 3 is maintained in such a tensioned state, the overlapped leading and trailing end portions 3*a*, 3*b* of the binding strap 3 are bonded together by means of a suitable seal or ferrule implement. Continuing further, after the leading and trailing end portions 3*a*, 3*b* of the binding strap 3 have been bonded together, the bonded trailing end portion 3*b* of the binding strap 3 is severed from the residual supply portion 3*c* of the binding strap 3, whereby the bound article 4 may then be removed from the vicinity of the strapping binding head 1.

With reference now being additionally made to FIG. 2 of the drawings, which corresponds to FIG. 3*b* of the drawings of the aforenoted patent to Kato, the drive roller system 2 is illustrated, and it is seen that the pair of drive rollers which form the drive roller system 2 comprises a feed wheel or traction wheel 2T and a back-up wheel 2B between which the binding strap 3 is interposed such that a predetermined amount of pressurized force is developed within the bight or nip portion defined between the traction wheel 2T and back-up wheel 2B. The traction wheel or feed wheel 2T is provided with a plurality of teeth which are continuously disposed or provided in a circumferential array around the peripheral edge of the feed wheel or traction wheel 2T, while the back-up wheel 2B is provided with a smooth peripheral surface. In accordance with the principles and teachings characteristic of the invention as disclosed within the aforenoted patent to Kato, the teeth of the feed wheel or traction wheel 2T also have a unique configuration so as to in fact facilitate control of the pressurizing force which develops the requisite tension within the binding strap 3 during the relatively high tensioning phase thereof. In particular, the pressurizing force is effectively reduced so as to in turn reduce marking scars conventionally produced by means of the traction wheel 2T upon the biding strap 3 as a result of the traction conveyance of the binding strap 3 through the bight or nip portion defined between the traction wheel 2T and the back-up wheel 2B.

While the particular traction wheel structure disclosed within the aforenoted patent to Kato has been commercially successful in view of the fact that, for example, by means of the aforenoted structure of the traction wheel, scarring of the binding strap has been effectively reduced, it has been experienced or determined that the teeth of the traction wheel have nevertheless on occasion caused slivers of the binding strap to be developed or generated. Not only do such slivers present safety issues or problems to users of the articles bound with the slivered strapping, but in addition, the production, generation, or development of such slivers adversely affects the tensile strength or structural integrity of the strapping which, of course, could lead to failure of the strapping either during the final tensioning stage of the strapping, during transportation of the bound or strapped article, or during unpacking of, or removal of the strapping material from, the bound article.

A need therefore exists in the art for a new and improved traction or feed wheel for use in connection with strapping apparatus wherein the traction wheel or feed wheel comprises unique and novel structure such that when the traction wheel or feed wheel is being used in conjunction with, for example, a suitable backup wheel in order to properly tension strapping material attendant the strapping or binding of an article, the generation or development of strapping material slivers is effectively prevented so as not to present any safety problems, and wherein further, the tensile strength or structural integrity characteristics of the strapping material are not adversely affected such that the strapping material will not experience failure either during the final tensioning stage of the strapping, during transportation of the bound or strapped article, or during unpacking of, or removal of the strapping material from, the bound article.

OBJECTS OF THE INVENTION

Accordingly, it is an object of the present invention to provide a new and improved feed wheel or traction wheel which is to be utilized in conjunction with binding or strapping apparatus for securely binding articles, such as, for example, strip coils, tubes, stacked plate, and the like, with suitable strapping material.

Another object of the present invention is to provide a new and improved feed wheel or traction wheel which is to be utilized in conjunction with binding or strapping apparatus for securely binding articles, such as, for example, strip coils, tubes, stacked plate, and the like, with suitable strapping material, and which effectively overcomes the various disadvantages or operational drawbacks characteristic of conventional or PRIOR ART feed wheels or traction wheels.

An additional object of the present invention is to provide a new and improved feed wheel or traction wheel which is to be utilized in conjunction with binding or strapping apparatus for securely binding articles, such as, for example, strip coils, tubes, stacked plate, and the like, with suitable strapping material, and which effectively overcomes the various disadvantages or operational drawbacks characteristic of conventional or PRIOR ART feed wheels or traction wheels by comprising structure which effectively eliminates the generation of slivers.

A further object of the present invention is to provide a new and improved feed wheel or traction wheel which is to be utilized in conjunction with binding or strapping apparatus for securely binding articles, such as, for example, strip coils, tubes, stacked plate, and the like, with suitable strapping material, and which effectively overcomes the various disadvantages or operational drawbacks characteristic of conventional or PRIOR ART feed wheels or traction wheels by comprising structure which effectively eliminates the generation of slivers so as to, in turn, eliminate any safety problems for end users of the strapped articles, and in addition, so as to ensure the tensile strength and structural integrity of the strapping material.

SUMMARY OF THE INVENTION

The foregoing and other objectives are achieved in accordance with the teachings and principles of the present invention through the provision of a new and improved feed wheel or traction wheel for use in connection with strapping apparatus or machinery wherein the feed wheel or traction wheel is normally or conventionally provided with, for example, a set of seventy-two (72) teeth which are cut into or formed upon the outer peripheral surface of the feed wheel or traction wheel along a 15° right hand helix, as considered with respect to the axis of the feed wheel or traction wheel, however, in addition to the aforenoted set of teeth, a second set of thirty-five (35) cuts is formed upon the outer peripheral surface of the feed wheel or traction wheel along a 20° left hand helix, as considered with respect to the axis of the feed wheel or traction wheel, so as to in effect form a second set of teeth or facets.

In this manner, as a result of the provision of such second set of oriented cuts defining, in effect, the second set of facets or teeth, the first set of teeth are effectively interrupted by means of a plurality of the second set of cuts such that the resulting side profiles or facets of such first set of teeth, as taken along their original 15° right hand helix cut directions, now have substantially trapezoidal configurations. In addition, as a result of the provision of the second set of cuts which are oriented, in effect, at an angle of 35° with respect to the orientation of the first set of teeth, the resulting side profiles or facets of the first set of teeth, as taken along the 20° left hand helix cut directions, now form the second set of teeth which have substantially triangular configurations. It has been found that by means of such interrelated cuts and resulting teeth structure, profiles, or facets, the generation of the aforenoted slivers, characteristic of conventional or PRIOR ART feed wheels or traction wheels is effectively eliminated. Accordingly, safety problems for end users of the strapped articles are likewise able to be effectively eliminated, and in addition, enhanced tensile strength characteristics and structural integrity of the strapping material is ensured.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
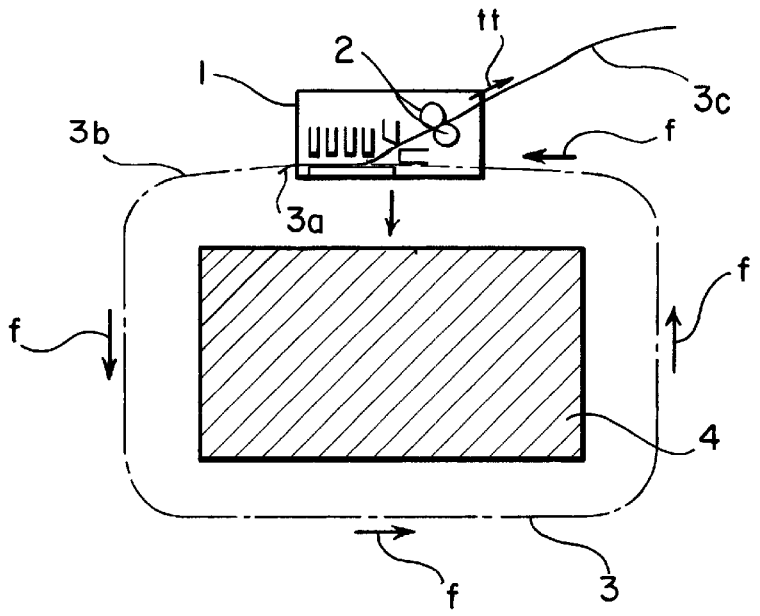
FIG. 1 (PRIOR ART)
FIG. 1 is a side elevational view schematically illustrating a PRIOR ART strap binding operation being performed with respect to an article being bound with strapping material.
Figure 2:
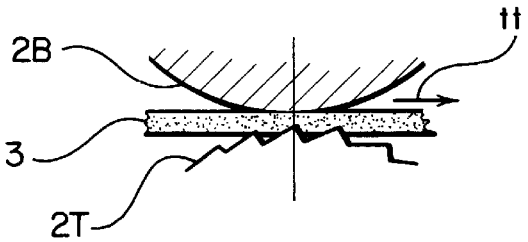
FIG. 2 (PRIOR ART)
FIG. 2 is a schematic cross-sectional view of a pair of PRIOR ART drive rollers used to tension the strapping material around the article being bound as disclosed within FIG. 1.
Figure 3:
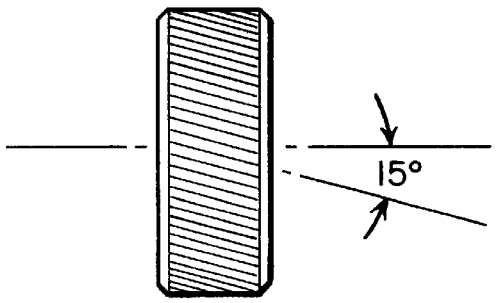
FIG. 3 (PRIOR ART)
FIG. 3 is an end elevational view of a conventional traction wheel or feed wheel showing the conventional set of teeth formed upon the outer peripheral surface of the wheel as formed along a 15° right hand helix.
Figure 4:
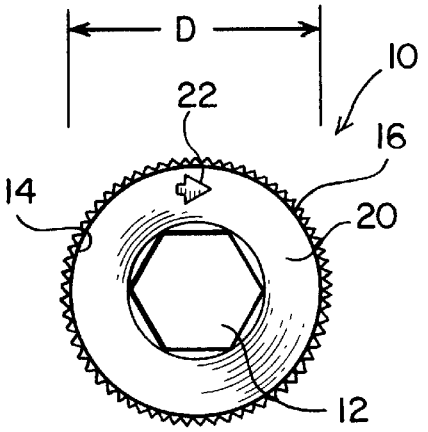
FIG. 4 is a side elevational view of the new and improved feed wheel or traction wheel which is constructed in accordance with the principles and teachings of the present invention and which comprises oppositely oriented cuts formed upon the outer peripheral surface of the feed wheel or traction wheel so as to form the first and second sets of teeth thereon.
Figure 5:
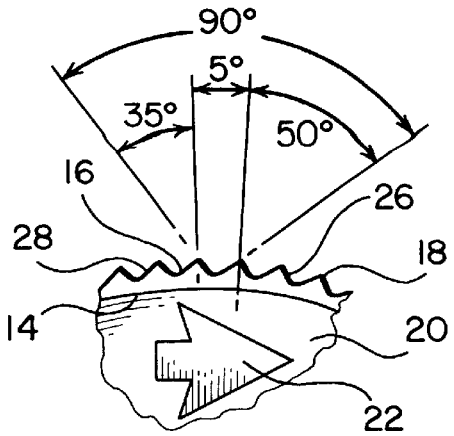
FIG. 5 is an enlarged view of a peripheral edge portion of the new and improved feed wheel or traction wheel as shown in FIG. 4 showing the details of the peripheral edge portions of the first set of teeth formed thereon.
Figure 6:
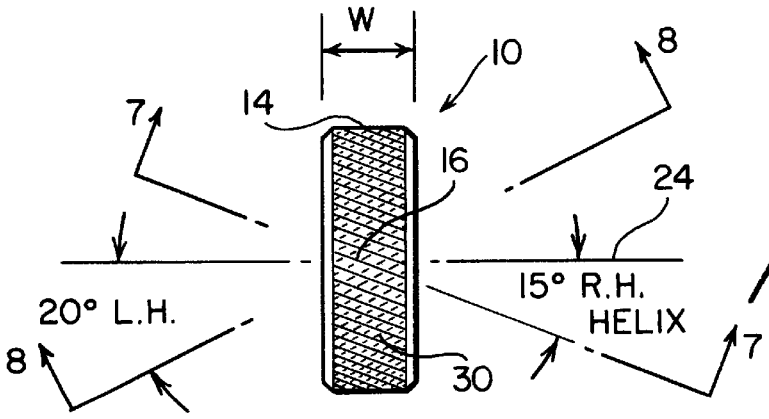
FIG. 6 is an end elevational view, similar to that of FIG. 3 showing, however, the new and improved feed wheel or traction wheel constructed in accordance with the principles and teachings of the present invention and specifically showing the cooperative parts thereof which comprises the oppositely oriented cuts formed upon the outer peripheral surface of the feed wheel or traction wheel so as to form the first and second sets of teeth thereon.

Referring now to the drawings, and more particularly to FIGS. 4–6 thereof, the new and improved feed wheel or traction wheel, constructed in accordance with the principles and teachings of the present invention, is disclosed and is generally indicated by the reference character 10. The feed wheel or traction wheel 10 is seen to have a diametrical extent D which is approximately one and three-eighths inches (1.375"), and is also seen to have a width dimension W which is approximately one-half inches (0.500"). The feed wheel or traction wheel 10 further comprises a central or axial through-bore 12 having a hexagonal configuration so as to in effect define a drive connection with a drive shaft, not shown, upon which the feed wheel or traction wheel 10 is mounted within its binding head, and an outer peripheral surface 14. The outer peripheral surface 14 of the traction wheel or feed wheel 10 is provided with a first set of seventy-two (72) teeth 16 which are equally and circumferentially spaced around the outer peripheral surface 14 such that the circumferential or angular spacing defined between adjacent teeth, as measured from crest 18 to crest 18, is 5°, and an external side surface 20 of the feed wheel or traction wheel 10 is provided with a direction mark 22 such that the feed wheel or traction wheel 10 is properly mounted upon the drive shaft, not shown, whereby the teeth 16 can properly engage the strapping material when, for example, the strapping material is to be tensioned. In addition, as best seen from FIG. 6, each one of the first set of teeth 16 is formed upon the outer peripheral surface 14 of the feed wheel or traction wheel 10 in accordance with a 15° right hand helix as measured with respect to the axis 24 of the feed wheel or traction wheel 10, and still further, as more particularly seen from FIG. 5, the teeth 16 are seen to have cross-sectional configurations which are substantially triangular in configuration with the angular expanse defined between the leading and trailing flanks being approximately 90°. In addition, and more specifically, it is seen that the angle defined between the leading flank 26 of each tooth 16 and its crest 18 is approximately 35°, while the angle defined between the trailing flank 28 of each tooth 16 and its crest is approximately 50°.

Figure 7:
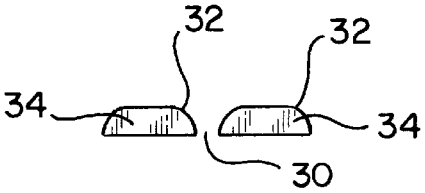
FIG. 7 is an elevational view of the feed wheel or traction wheel as shown in FIG. 6 and as taken along line 7—7 of FIG. 6.
Figure 8:
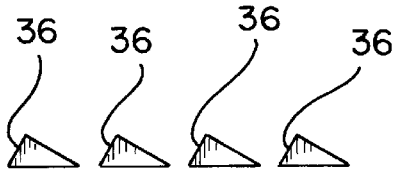
FIG. 8 is an elevational view of the feed wheel or traction wheel as shown in FIG. 6 and as taken along line 8—8 of FIG. 6.

Continuing further, and with specific reference now being made to FIGS. 6–8 in order to appreciate the structural features characteristic of the new and improved feed wheel or traction wheel 10 constructed in accordance with the principles and teachings of the present invention, it is further seen that the outer peripheral surface 14 of the feed wheel or traction wheel 10 is provided with a set of thirty-five (35) cuts 30 which are equally and circumferentially spaced around the outer peripheral surface 14 of the feed wheel or traction wheel 10 such that the circumferential or angular spacing defined between adjacent cuts 30 is approximately 10°. In addition, it is further seen that each one of the cuts 30 comprising the set of cuts 30 is formed upon the outer peripheral surface 14 of the traction wheel or feed wheel 10 in accordance with a 20° left hand helix as measured with respect to the axis 24 of the feed wheel or traction wheel 10. Accordingly, each one of the cuts 30 intersects or crosses a plurality of the first set of teeth 16, and the root portion of each one of the cuts 30 comprising the set of cuts 30 is noted as being made to a predetermined depth dimension of, for example, the same as the root or depth dimension as each tooth 16 of the first set of teeth 16, or within a range of up to 0.010 inches below the root or depth dimension of each tooth 16 of the first set of teeth 16. In this manner, each tooth 16 of the first set of teeth 16 is now divided or discretely separated into a plurality of adjacent tooth sections 32, and as best seen in FIG. 7, each one of such adjacent tooth sections 32, as taken or viewed along planes parallel to the 15° right hand helix directions of the first set of teeth 16, defines a side tooth facet 34 which has a substantially trapezoidal configuration. In a similar manner, the provision and existence of the set of cuts 30, each one of which intersects a plurality of the first set of teeth 16, causes in effect a second set of teeth 36 to be defined upon the outer peripheral surface 14 of the feed wheel or traction wheel 10 and upon end portions of the first set of teeth 16. As best seen from FIG. 8, each tooth 36 of such second set of teeth 36, as taken or viewed along planes parallel to the 20° left hand helix directions of the cuts 30, has a substantially triangular configuration, and more particularly, the triangular configuration may be that of a non-equilateral triangle.

As a result of the provision of the set of cuts 30 formed upon the outer peripheral surface 14 of the traction wheel or feed wheel 10, whereby the first and second sets of teeth 16, 36 are provided or defined upon the feed wheel or traction wheel 10, it has been determined and experienced that the generation of slivers, as formed by means of the PRIOR ART feed wheel or traction wheel 2T engaging the strapping material under highly tensioned conditions, is effectively prevented. Accordingly, it may be seen that in accordance with the various principles and teachings of the present invention, there has been developed a new and improved feed wheel or traction wheel, for use in connection with article strapping or binding apparatus, which effectively eliminates the generation of strapping material slivers so as not to present safety problems for end users of strapped articles, and in addition, the tensile strength and structural integrity of the strapping material is effectively preserved.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A traction wheel for use within strapping apparatus used for tensioning strapping material around articles to be bound with the strapping material, comprising:

a wheel having an outer peripheral surface, and an axial throughbore defined therethrough, and around an axis, for permitting said wheel to be mounted upon a rotary drive shaft so as to define a drive connection therewith;

a first set of teeth formed upon said outer peripheral surface of said wheel for engaged contact with strapping material so as to impress tensioning forces upon the strapping material, each one of said teeth forming said first set of teeth being disposed at a first predetermined angle with respect to said axis of said wheel; and a set of cuts formed upon said outer peripheral surface of said wheel at a second predetermined angle, other than 90°, with respect to said axis of said wheel, wherein each one of said cuts forming said set of cuts intersects a plurality of said first set of teeth so as to discretely separate each one of said first set of teeth into a plurality of first tooth sections, and wherein further, each one of said cuts of said set of cuts forms a second set of teeth upon said outer peripheral surface of said wheel for engaged contact with the strapping material so as to also impress tensioning forces upon the strapping material, whereby the generation of slivers from the strapping material is effectively prevented so as to render articles bound with the strapping material safe to end users of the bound articles, and to preserve the tensile strength and structural integrity of the strapping material.

2. The traction wheel as set forth in claim 1, wherein:

said first set of teeth are formed upon said outer peripheral surface of said wheel in accordance with a 15° right hand helix with respect to said axis of said wheel.

3. The traction wheel as set forth in claim 1, wherein:

said set of cuts are formed upon said outer peripheral surface of said wheel in accordance with a 20° left hand helix with respect to said axis of said wheel.

4. The traction wheel as set forth in claim 1, wherein:

each one of said first set of teeth has a substantially triangular cross-section configuration.

5. The traction wheel as set forth in claim 1, wherein:

each one of said discretely separate first tooth sections has a side facet which has a substantially trapezoidal configuration.

6. The traction wheel as set forth in claim 1, wherein:

each tooth of said second set of teeth has a substantially triangular configuration.

7. The traction wheel as set forth in claim 6, wherein:

each tooth of said second set of teeth is formed upon an end portion of a respective one of said first teeth.

8. The traction wheel as set forth in claim 1, wherein:

said first set of teeth comprise seventy-two (72) teeth equiangularly spaced from each other upon said outer peripheral surface of said wheel through an angular spacing of 5°.

9. The traction wheel as set forth in claim 1, wherein:

said set of cuts comprises thirty-five (35) cuts equiangularly spaced from each other upon said outer peripheral surface of said wheel through an angular spacing of approximately 10°.

10. A feed wheel for use within a strapping implement used for tensioning strapping material around articles to be bound with the strapping material, comprising:

a wheel having an outer peripheral surface, and an axial throughbore defined therethrough, and around an axis, for permitting said wheel to be mounted upon a rotary drive shaft so as to define a drive connection therewith;

a first set of teeth formed upon said outer peripheral surface of said wheel for engaged contact with strapping material so as to impress tensioning forces upon the strapping material, each one of said teeth forming said first set of teeth being disposed at a first predetermined angle with respect to said axis of said wheel; and a set of cuts formed upon said outer peripheral surface of said wheel at a second predetermined angle, other than 90°, with respect to said axis of said wheel, wherein each one of said cuts forming said set of cuts intersects a plurality of said first set of teeth so as to discretely separate each one of said first set of teeth into a plurality of first tooth sections, and wherein further, each one of said cuts of said set of cuts forms a second set of teeth upon said outer peripheral surface of said wheel for engaged contact with the strapping material so as to also impress tensioning forces upon the strapping material, whereby the generation of slivers from the strapping material is effectively prevented so as to render articles bound with the strapping material safe to end users of the bound articles, and to preserve the tensile strength and structural integrity of the strapping material.

11. The feed wheel as set forth in claim 10, wherein:

said first set of teeth are formed upon said outer peripheral surface of said wheel in accordance with a 15° right hand helix with respect to said axis of said wheel.

12. The feed wheel as set forth in claim 10, wherein:

said set of cuts are formed upon said outer peripheral surface of said wheel in accordance with a 20° left hand helix with respect to said axis of said wheel.

13. The feed wheel as set forth in claim 10, wherein:

each one of said first set of teeth has a substantially triangular cross-section configuration.

14. The feed wheel as set forth in claim 10, wherein:

each one of said discretely separate first tooth sections has a side facet which has a substantially trapezoidal configuration.

15. The feed wheel as set forth in claim 10, wherein:

each tooth of said second set of teeth has a substantially triangular configuration.

16. The feed wheel as set forth in claim 15, wherein:

each tooth of said second set of teeth is formed upon an end portion of a respective one of said first teeth.

17. The feed wheel as set forth in claim 10, wherein:

said first set of teeth comprise seventy-two (72) teeth equiangularly spaced from each other upon said outer peripheral surface of said wheel through an angular spacing of 5°.

18. The feed wheel as set forth in claim 10, wherein:

said set of cuts comprises thirty-five (35) cuts equiangularly spaced from each other upon said outer peripheral surface of said wheel through an angular spacing of approximately 10°.

19. A traction feed wheel for use within a strapping machine used for tensioning strapping material around articles to be bound with the strapping material, comprising:

a wheel having an outer peripheral surface, and an axial throughbore defined therethrough, and around an axis, for permitting said wheel to be mounted upon a rotary drive shaft so as to define a drive connection therewith;

a first set of teeth formed upon said outer peripheral surface of said wheel for engaged contact with strapping material so as to impress tensioning forces upon the strapping material, each one of said teeth forming said first set of teeth being disposed at a first predetermined angle with respect to said axis of said wheel; and a set of cuts formed upon said outer peripheral surface of said wheel at a second predetermined angle, other than 90°, with respect to said axis of said wheel, wherein each one of said cuts forming said set of cuts intersects a plurality of said first set of teeth so as to discretely separate each one of said first set of teeth into a plurality of first tooth sections, and wherein further, each one of said cuts of said set of cuts forms a second set of teeth upon said outer peripheral surface of said wheel for engaged contact with the strapping material so as to also impress tensioning forces upon the strapping material, whereby the generation of slivers from the strapping material is effectively prevented so as to render articles bound with the strapping material safe to end users of the bound articles, and to preserve the tensile strength and structural integrity of the strapping material.

20. The traction feed wheel as set forth in claim 19, wherein:

said first set of teeth are formed upon said outer peripheral surface of said wheel in accordance with a 15° right hand helix with respect to said axis of said wheel.

21. The traction feed wheel as set forth in claim 19, wherein:

said set of cuts are formed upon said outer peripheral surface of said wheel in accordance with a 20° left hand helix with respect to said axis of said wheel.

22. The traction feed wheel as set forth in claim 19, wherein:

each one of said first set of teeth has a substantially triangular cross-sectional configuration.

23. The traction feed wheel as set forth in claim 19, wherein:

each one of said discretely separate first tooth sections has a side facet which has a substantially trapezoidal configuration.

24. The traction feed wheel as set forth in claim 19, wherein:

each tooth of said second set of teeth has a substantially triangular configuration.

25. The traction feed wheel as set forth in claim 24, wherein:

each tooth of said second set of teeth is formed upon an end portion of a respective one of said first teeth.

26. The traction feed wheel as set forth in claim 19, wherein:

said first set of teeth comprise seventy-two (72) teeth equiangularly spaced from each other upon said outer peripheral surface of said wheel through an angular spacing of 5°.

27. The traction feed wheel as set forth in claim 19, wherein:

said set of cuts comprises thirty-five (35) cuts equiangularly spaced from each other upon said outer peripheral surface of said wheel through an angular spacing of approximately 10°.

* * * * *